US006190428B1

(12) United States Patent
Rolison et al.

(10) Patent No.: US 6,190,428 B1
(45) **Date of Patent: *Feb. 20, 2001**

(54) ELECTROCHEMICAL PROCESS FOR REMOVING LOW-VALENT SULFUR FROM CARBON

(75) Inventors: Debra R. Rolison, Arlington; Karen E. Swider, Alexandria, both of VA (US)

(73) Assignee: The United States of America as represented by the Secretary of the Navy, Washington, DC (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/621,404

(22) Filed: Mar. 25, 1996

(51) Int. Cl.[7] ..... C10L 9/00
(52) U.S. Cl. ..... 44/624; 205/696; 205/768
(58) Field of Search ..... 44/622, 624; 205/768, 205/696; 429/40

(56) References Cited

U.S. PATENT DOCUMENTS

| | | | | |
|---|---|---|---|---|
| 3,645,860 | * | 2/1972 | Fishman et al. | 205/171 |
| 3,857,737 | * | 12/1974 | Kemp et al. | 252/182.1 |
| 4,279,711 | * | 7/1981 | Vining et al. | 205/341 |
| 4,518,705 | * | 5/1985 | Solomon et al. | 429/42 |
| 4,636,294 | * | 1/1987 | Novack et al. | 205/786.5 |
| 4,704,136 | | 11/1987 | Weston et al. | 48/197 R |
| 4,775,452 | * | 10/1988 | Kunninaga et al. | 205/348 |
| 5,624,718 | * | 4/1997 | Dearnaley | 427/530 |

OTHER PUBLICATIONS

Lalvani et al., "Sulphur removal from coal by electrolysis", Fuel 62 427–37 (Apr. 1983). Month unavailable.
Lalvani et al., "Coal Cleaning in A Semi–continuous Flow Reactor: Galvanostatic Studies", Fuel Processing Tech. 21 117–23 (1989). Month unavailable.

* cited by examiner

*Primary Examiner*—Margaret Medley
(74) *Attorney, Agent, or Firm*—Barry A. Edelberg; John J. Karasek

(57) ABSTRACT

The present invention is, in one aspect, a process for removing low-valent sulfur from carbon containing such low-valent sulfur (sulfur-containing carbon), having the step of contacting the sulfur-containing carbon with a platinum oxide in an aqueous environment, for a time sufficient to remove a desired amount of low-valent sulfur from the sulfur-containing carbon, especially from the surface of the carbon. Another aspect of the invention is an electrode, comprising an electrocatalyst or active material for a fuel cell or battery, disposed in a carbon matrix, where the carbon matrix is essentially free of low-valent sulfur adjacent to the active material of the battery electrode or electrocatalyst of the fuel cell electrode. Such an electrode will be suitable for use in a fuel cell or in a battery. Another aspect of the invention is a fuel cell or a battery using this electrode.

5 Claims, 8 Drawing Sheets

1.6
counts 2.5
counts 2.8
counts 170
160
BINDING ENERGY / eV

FIG. 8
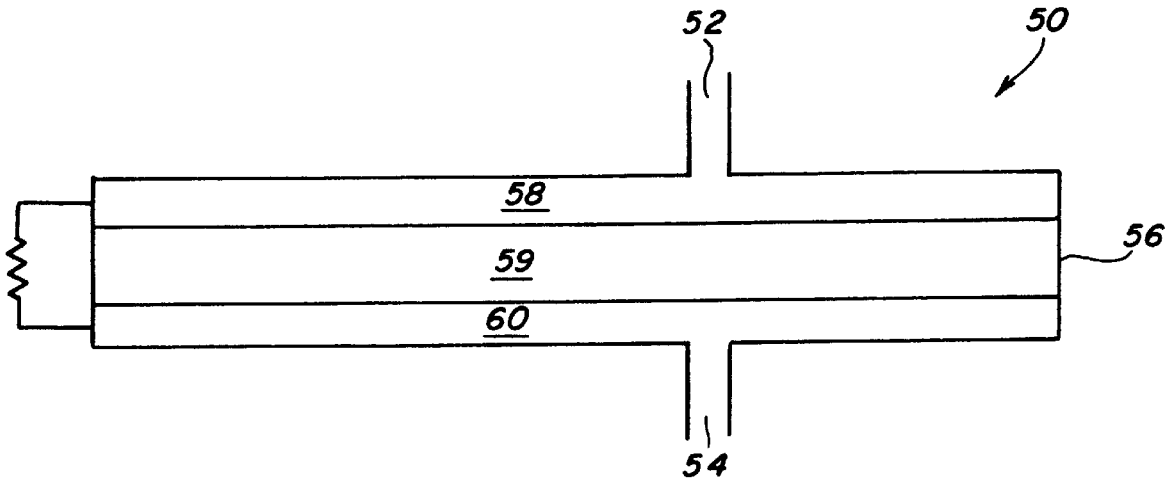
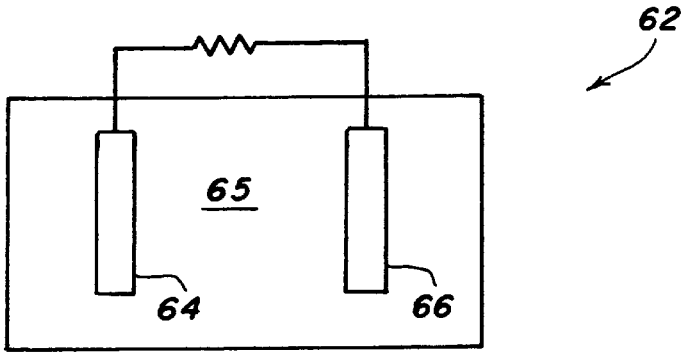
FIG. 9

ELECTROCHEMICAL PROCESS FOR REMOVING LOW-VALENT SULFUR FROM CARBON

BACKGROUND OF THE INVENTION

1. Field of the Invention

The present invention relates to improvements in the lifetimes of carbon-supported electrodes used in fuel cells and batteries by the removal of low-valent sulfur (which acts as a catalytic poison) from the carbon in these electrodes, through a catalytic process. The invention also relates to removing sulfur from coal and other carbon blacks. The invention also relates to producing sulfate ion.

2. Description of the Related Art

As used herein, "low-valent sulfur" refers to sulfur in a zero or negative oxidation state. This includes, but is not limited to, zero-valent organic sulfur (sulfur covalently bonded to carbon, but not to oxygen). Such organic sulfur may be part of an organic ring or chain (typically 5- or 6-membered heterocyclic rings). Most typically, organic sulfur will be part of an aromatic group like thiophene or thiophene derivatives. Low-valent sulfur also includes negative valence species such as metal sulfides (e.g., CoS, FeS, $FeS_2$), and hydrogen sulfide $H_2S$. These species may be found in carbon samples as impurities, where they may be dissolved, agglomerated, adsorbed, etc. As used herein, the term "sulfur-containing carbon" refers to all of these species.

Referring to FIG. 8, fuel cells 50 are devices that produce electricity from electrochemical reactions. The reactants in fuel cells are replenished as needed, typically in a continuous flow process. Consequently, fuel cells 50 generally have one or more inlet ports 52 for reactants (i.e., the fuel and the oxidant), and an outlet port 54 for the reaction products, in the reaction vessel 56. All fuel cells have, in the reaction vessel, an anode 58 and a cathode 60, which are separated from each other by an electrolyte 59. In the fuel cell art, the term "electrolyte" is used in its broadest sense: a material, composition, or structure that passes ions but not electrons between the two electrodes. Most modern fuel cell electrolytes are solid phase, such as polymer membranes, although liquid electrolytes for fuel cells are also known. Some exemplary solid phase electrolytes include sulfonated fluorocarbon polymers such as Nafion™ (DuPont), and ceramic oxides such as yttria-stabilized zirconia ($Y_2O_3.ZrO_2$, a.k.a. YSZ).

The electrodes used for fuel cells typically use some type of noble metal or noble metal alloy as a catalyst. These are referred to in the art as electrocatalysts. Common electrocatalysts include platinum metal (e.g., platinum black), platinum alloys (such as PtSn, PtRu, and multiple ternary platinum alloys), and cobalt-centered macrocycles. For a variety of reasons, in particular the high cost of many of these electrocatalysts, it is typical to put the electrocatalyst on a carbon matrix. This can be done by mixing the electrocatalyst with a carbon matrix, or supporting the electrocatalyst on a carbon support matrix. A particularly common electrode, ca. 25 Å Pt metal clusters on a vulcan carbon support matrix is described in greater detail below. Some types of carbon that have been used as matrices for electrocatalysts include vulcan carbon, pyrolitic carbon, glassy carbon, and carbon blacks. Vulcan carbon is a form of carbon that contains low-valent sulfur, due to its production process. It has a number of desirable properties, but, as described below, it also has some undesirable properties for use as an electrocatalyst matrix.

Proton-exchange membrane fuel cells (PEMFCs) are an attractive alternative to petroleum-based energy sources. In these electrochemical cells, hydrogen is oxidized to protons at the anode; the protons then transfer through the PEM and combine with reduced oxygen at the cathode to form water. See generally A. J. Appleby and F. R. Foulkes, Fuel Cell Handbook, (Van Nostrand Reinhold, New York) (1989) and H. P. Dhar, J. Electroanal. Chem., 357, 237 (1993), both of which are incorporated by reference herein. These oxidation and reduction reactions are catalyzed at the fuel-cell electrodes by platinum or noble-metal alloys. To reduce the cost of the electrodes, the traditional Pt-black electrodes of PEMFCs and phosphoric acid fuel cells (PAFCs) have been replaced by carbon-supported noble-metal clusters. By using clusters on the order of 25 Å in diameter instead of noble metal blacks, the mass activity of the noble metal is dramatically increased. See K. Kinoshita, J. Electrochem. Soc., 137, 845 (1990).

A chronic concern in the engineering of a fuel cell is to prevent poisoning of the electrode catalysts, particularly by sulfur. One source of sulfur is $H_2S$ gas, a common impurity in fuel gas. The sulfurous gas dissociatively adsorbs on the Pt surface and then blocks the available sites for catalysis of the fuel. See D-T. Chin and P. D. Howard, J. Electrochem. Soc., 133, 2447 (1986), and J. Biswas et al. Catal. Rev.—Sci. Eng. 30, 161 (1988), both of which are incorporated by reference herein.

Another source of sulfur in fuel cell electrodes comes from the carbon support. In the vulcanized carbon that is favored as a support, to its high electronic conductivity (especially relative to other carbon blacks) and surface properties (e.g., wetting behavior) (see J. McBreen et al., J. Appl. Electrochem., 11, 787 (1981), incorporated by reference herein). However, there is approximately 5000 ppm (weight) of sulfur in vulcan carbon. See K. Kinoshita, Carbon: Electrochemical and Physicochemical Properties (John Wiley and Sons, New York) (1988), G. Tamizhmani and G. A. Capuano, J. Electrochem. Soc., 141, L132 (1994), both of which are incorporated by reference herein. This corresponds to one sulfur atom for every 3.3 platinum atoms in a typical 10 wt % Pt/carbon electrocatalyst (see Kinoshita et al., J. Electrochem. Soc. 137 845 (1990), incorporated by reference herein), so the ratio of Pt surface atoms to S atoms is ca. 1.5 to 1 in a 10 wt % Pt/carbon material. Because a single sulfur atom can poison multiple Pt sites (see J. Biswas et al., supra, and T. D. Halachev and E. Ruckenstein, Surf. Sci., 108, 292 (1981), both of which are incorporated by reference herein), there is sufficient S in the vulcan carbon to poison the entire surface area of the supported Pt clusters. Yet, the excellent initial performance of PAFCs and PEMFCs and the low overpotentials observed at their anodes suggest that the sulfur in the carbon support has no influence on the fuel cells, and this high concentration of native sulfur is generally overlooked. Until now, it had not been shown that carbon-associated sulfur in fuel cell electrodes would affect the performance of fuel cell electrocatalysts. Currently available Pt-C electrodes lose 10–100% of their performance efficiency after about 6 months of use.

Referring to FIG. 9, batteries are conceptually and structurally similar to fuel cells, except that they are closed systems—fuel normally is neither added to nor removed from batteries during discharge or optional recharge (for rechargeable batteries). Thus, a battery 62 has an anode 64 and a cathode 66 separated by an electrolyte 65. Similar concerns for electrode lifetime apply to batteries as apply to fuel cells. One immediate problem is that many batteries lose ca. 10% of their total battery capacity after the first charge-discharge cycle, whereupon reasonably stable performance results. Slightly different terminologies are used for batteries, however. Instead of "electrocatalyst", practitioners in the battery art refer to "active material". Also, the roles of the anode and the cathode are reversed during recharge.

A chronic barrier to the use of naturally occurring hydrocarbons (i.e., coal and crude petroleum) as an energy source is the presence of environmentally unfriendly sulfur in these substances. Techniques are available for removing sulfur from naturally occurring hydrocarbons, including thiophene-like sulfur or S that is covalently bonded to carbon atoms. However, many of these procedures require elevated temperatures (>100° C.), or long times to achieve desulfurization. One proposed method (see S. B. Lalvani et al., *Fuel Processing Tech.* 21 117–123 (1989)) performs this process electrochemically, but teaches that a highly concentrated electrolyte solution (1 M NaOH) is required. It is generally undesirable to carry out industrial processes in electrolytes of high ionic strength (e.g., concentration ≧1 M of acid, base, or salt solutions), for reasons including cost, workplace safety, and pollution control.

Sulfuric acid, an important commercial reagent, is commonly manufactured by hydrogenation of sulfate ($SO_4^{2-}$) ion. Accordingly, commercial processes for the production of sulfate are desired.

SUMMARY OF THE INVENTION

Accordingly, it is an object of this invention to remove S, especially low-valent S, from carbon contaminated with low-valent S.

It is a further object of this invention to extend the useful lifetimes of electrodes used in batteries and fuel cells, by preventing the catalytic poisoning effect arising from S contained in the carbon matrices of these electrodes.

It is a further object of this invention to provide a low-cost method for producing oxidized S, in particular sulfate ($SO_4^{2-}$) ion, which is an industrial precursor for $H_2SO_4$.

It is a further object of this invention to achieve each of these goals at ambient or near ambient temperatures, under mild chemical conditions and low ionic concentrations (e.g., ca. 0.05 M electrolyte).

These and additional objects of the invention are accomplished by the structures and processes hereinafter described.

The present invention is, in one aspect, a process for removing low-valent sulfur from carbon containing such low-valent sulfur (sulfur-containing carbon), having the step of contacting the sulfur-containing carbon with a platinum oxide in an aqueous environment, for a time sufficient to remove a desired amount of low-valent sulfur from the sulfur-containing carbon, especially from the surface of the carbon.

Another aspect of the invention is an electrode, comprising an electrocatalyst or active material for a fuel cell or battery, disposed in a carbon matrix, where the carbon matrix is essentially free of low-valent sulfur adjacent to the active material of the battery electrode or electrocatalyst of the fuel cell electrode. Such an electrode will be suitable for use in a fuel cell or in a battery.

Another aspect of the invention is a fuel cell, comprising: (a) a fuel cell reaction vessel having an output port for removing reaction products, and at least one input port for introducing reactants, where the fuel cell reaction vessel contains an electrolyte, (b) a cathode disposed within the reaction vessel and (c) an anode disposed within the reaction vessel, where at least one of the electrodes comprises an electrocatalyst (typically a noble metal or noble metal alloy) in contact with a carbon matrix, where this carbon matrix is essentially free of low-valent sulfur adjacent to the electrocatalyst, and where the electrodes are separated by the electrolyte.

Another aspect of the invention is a method of generating electricity from a fuel cell, comprising: (a) introducing a fuel and an oxidant into a fuel cell reaction vessel containing an electrolyte, (b) reducing the oxidant at a cathode in the reaction vessel, (c) oxidizing the fuel at an anode in the reaction vessel, where at least one of the electrodes comprises an electrocatalyst (typically a noble metal or noble-metal alloy) in contact with a carbon matrix, where this carbon matrix is essentially free of low-valent sulfur adjacent to the electrocatalyst, and where the electrodes are separated by the electrolyte, and (d) removing products of the oxidation and the reduction from the fuel cell.

Another aspect of the invention is a battery, comprising: (a) a vessel containing an electrolyte, (b) a cathode disposed within the vessel and (c) an anode disposed within the vessel, where at least one of the electrodes comprises an active material (typically a metal chalcogenide, e.g., $MO_x$, $MS_x$, or $MSe_x$) in contact with a carbon matrix or a carbon-only matrix, where this carbon matrix is essentially free of low-valent sulfur adjacent to the active material, and where the electrodes are separated by the electrolyte.

Another aspect of the invention is a method for generating electricity from a battery, comprising: (a) providing a reducing agent and an oxidant in a battery vessel containing an electrolyte, (b) reducing the oxidant at a cathode in the battery vessel, and (c) oxidizing the reducing agent at an anode in the battery vessel, where at least one of the electrodes comprises an active material (typically a metal chalcogenide) in contact with a carbon matrix, where this carbon matrix is essentially free of low-valent sulfur adjacent to the active material, and where the electrodes are separated by the electrolyte.

Another aspect of the invention is a method for producing sulfate ion, comprising the steps: (a) contacting carbon containing low-valent sulfur with a platinum oxide in an aqueous environment, to convert the low-valent sulfur to sulfate ion; and (b) extracting the sulfate ion.

BRIEF DESCRIPTION OF THE DRAWINGS

A more complete appreciation of the invention will be obtained readily by reference to the following Description of the Preferred Embodiments and the accompanying drawings in which like numerals in different figures represent the same structures or elements, wherein:

FIG. 8 shows a cross-section of a fuel cell.

FIG. 9 shows a cross-section of a battery.

DETAILED DESCRIPTION OF THE PREFERRED EMBODIMENTS

K. E. Swider et al., "The Chemical State of Sulfur in Carbon-Supported Fuel Cell Electrodes", J. Electrochem. Soc. 143 (3) p. 813 (March 1996, in press), is incorporated by reference herein, in its entirety, for all purposes.

As noted above, vulcan carbon is a favored support for fuel cell electrocatalysts and battery active materials. It has been discovered that the vulcan carbon used to support platinum catalysts in electrodes contains high concentrations of the catalytic poison S, which is covalently bonded to the carbon, as in carbon chains or rings. It has further been discovered that this covalently bonded, zero-valence sulfur may be removed from this carbon (i.e., the covalent C—S bonds may be broken) if the sulfur is brought into contact with oxidized Pt in the presence of water and heat. It has further been discovered that this desulfurization may be done electrochemically, by maintaining a platinum electrode at a potential (volts vs. a reference potential) in the oxide region of its current-voltage curve, preferably in low-ionic strength solution.

Figure 1:
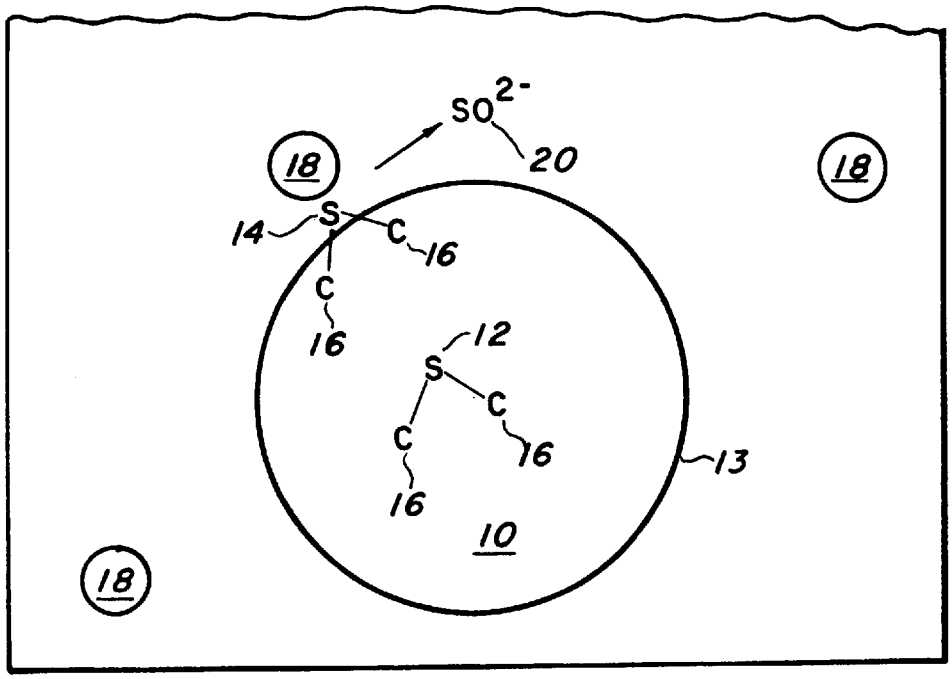
FIG. 1 is a representation of a Pt in contact with a typical particle of sulfur-containing carbon, catalytically oxidizing the sulfur to sulfate.

Thus, as shown in FIG. 1, a particle of sulfur-containing carbon 10 may typically have sulfur atoms 12 that are in positions that are inaccessible to surrounding platinum particles (e.g., the sulfur atom may be in the interior of the particle 10). The particle of carbon 10 will also typically have sulfur atoms 14 that are in positions that are accessible to surrounding platinum particles (e.g., the sulfur atom may be at or near the exterior surface 13 of the particle 10). In both of these cases, the sulfur atoms typically are covalently bonded to carbon atoms 16. It should be noted, however, that the position of a given sulfur atom may change over time, and with its position change, its accessibility by platinum may also change. When a Pt particle 18 contacts a sulfur atom 14 in the presence of water and heat, the S—C bonds are broken and the sulfur is oxidized to water soluble sulfate ion 20.

Figure 2:
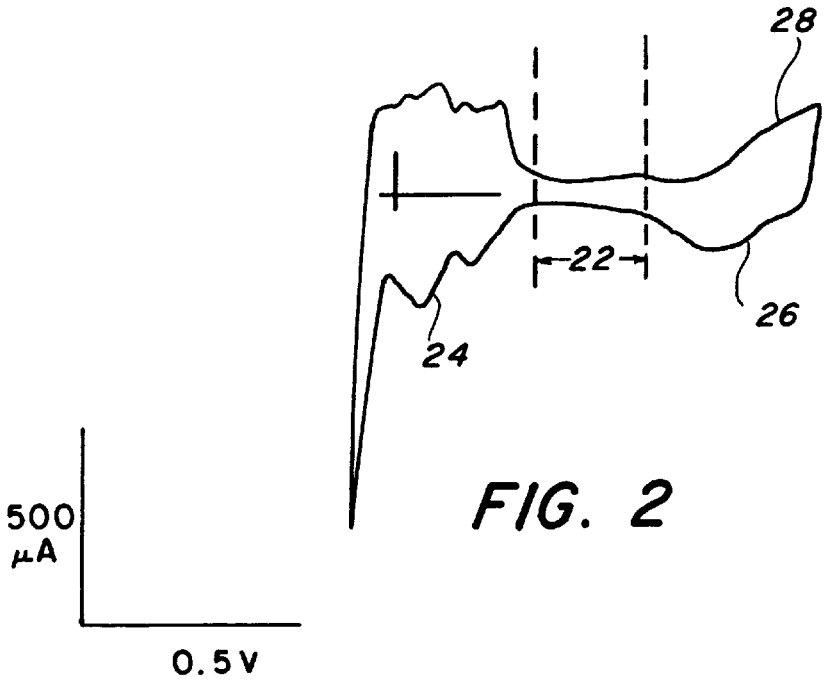
FIG. 2 shows a cyclic voltammetry curve for platinum in $H_2SO_4$.

Referring to FIG. 2, this shows a cyclic voltammetry curve for platinum in $H_2SO_4$. The dashed lines have been added for illustration. The area between the two dashed lines is referred to as the double layer region 22 of the cyclic voltammetry curve. To the left of this area is the hydrogen region 24 of the cyclic voltammetry curve. To the right of this double layer area 22 is the oxide region 26 of the cyclic voltammetry curve. At the rightmost end of this oxide region, the curve tips upward. This upwardly tipped region is the oxygen evolution portion 28 of the cyclic voltammetry curve.

In a preferred method for removal of sulfur from carbon which contains sulfur, platinum oxide is provided by putting a platinum electrode in a dilute acid, base, or ionic solution in the oxide region of the current-voltage curve. In this part of the curve, as the name suggests, platinum on the surface of this electrode will be in the form of a platinum oxide—$PtO_x$ where $0<x<2$, preferably where ca. $0.5<x<$ca 1.0. Typically, some type of ionic solution will be used to assist in the formation of platinum oxide, as skilled practitioners will recognize. The platinum oxide is put into contact with the carbon. During this contacting, low-valent sulfur atoms that come into contact with platinum oxide will be oxidized to sulfate, which is soluble in water. This sulfate can then be washed out.

Skilled practitioners will recognize that the location of the oxide region of the platinum electrode will depend on the local environment of the platinum. For example, in mild acidic conditions (e.g., ca. 0.05 M $HNO_3$) it is known that maintaining an electrode potential of about 1 volt versus a hydrogen reference is sufficient to keep Pt oxidized.

It has been discovered that, contrary to the teaching of Lalvani et al., it is not necessary to use high potentials to remove sulfur from coal or other forms of carbon. See Lalvani et al., Fuel Processing Tech. 18 25–36 (1988). Lalvani uses a very high potential, in the oxygen evolution portion of the cyclic voltammetry curve. It has been found that this is not only not necessary, but somewhat counter-productive. It has also been found that contrary to the teaching of Lalvani et al., it is not necessary to use high ionic strengths. Lalvani uses 1 M NaOH. In contrast, half-molar, tenth-molar, and even hundredth-molar ion contents are sufficient, as long as Pt is in the oxide region (preferably below the oxygen evolution region) of the current-voltage curve.

A preferred electrode for use in power sources according to the invention has an electrocatalyst or active material (as noted above, these two terms are used in the fuel cell art and battery art, respectively), mixed with or supported on a carbon matrix, where the carbon comprises carbon particles having a reduced concentration of sulfur atoms that are accessible to platinum, compared to the 5000 ppm concentration of standard vulcan carbon. More preferably, the concentration of sulfur atoms that are accessible to platinum is less than about 500 ppm. Still more preferably, the concentration of sulfur atoms that are accessible to platinum is less than about 50 ppm. Most preferably, the concentration of sulfur atoms that are accessible to platinum is essentially zero.

A preferred fuel cell according to the invention uses the preferred electrode of the invention as the anode and/or the cathode. In operation, the reduced sulfur content at the surface of the carbon matrix retards the poisoning of the electrocatalyst. In the most preferred embodiment of the invention, where the concentration of sulfur atoms at or near the surface of the carbon particles is essentially zero, the electrocatalyst will avoid being poisoned until such time as any remaining carbon-associated sulfur atoms that were initially inaccessible to the electrocatalyst may migrate to positions or otherwise become accessible to the electrocatalyst, and subsequently poison the electrocatalyst. For example, if the carbon matrix partially decomposes, previously inaccessible sulfur may become accessible. To date, fuel cell operation in excess of 1000 hours has been demonstrated consistently.

A preferred battery according to the present invention uses the preferred electrode of the invention as the anode and/or the cathode. In operation, the reduced sulfur content at the surface of the carbon matrix retards the poisoning of the active material. In the most preferred embodiment of the invention, where the concentration of active material-accessible sulfur atoms is essentially zero, the active material will avoid being poisoned until such time as any sulfur atoms which were inaccessible become accessible to the active material, and subsequently poison the active material.

Having described the invention, the following examples are given to illustrate specific applications of the invention, including the best mode now known to perform the invention. These specific examples are not intended to limit the scope of the invention described in this application.

General Experimental Procedures and Standards

To understand the behavior of the sulfur in carbon-supported platinum electrocatalysts, we have examined its chemical state at different stages in the preparation of fuel-cell electrodes. This is achieved in three ways: (1) by measuring the oxidation state of the sulfur in the electrocatalysts using x-ray photoelectron spectroscopy (XPS); (2) by qualitatively monitoring the presence of sulfate ion in the aqueous filtrate created after slurrying the electrode materials in water; and (3) by examining the electrochemistry of the electrocatalysts. These results yield information about the interaction of platinum with the sulfur impurities native to the vulcan carbon and lead to suggestions about how to reduce possible poisoning of fuel-cell electrodes during long-term operation.

Four different materials have been analyzed. Vulcan carbon [XC-72] (Cabot) and platinum black (fuel-cell grade Johnson Matthey) are used as baseline materials. A "model" electrocatalyst is prepared by grinding together 10 wt % Pt black (having ca. 100-Å particles) with the vulcan carbon, $C_{(XC\text{-}72)}$. As an example of a typical fuel-cell electrocatalyst, we use 10% Pt supported on $C_{(XC\text{-}72)}$ (E-TEK). The Scherrer formula is used to analyze the peak broadening in the x-ray diffraction patterns of the E-TEK electrocatalyst and to confirm the quoted Pt cluster size of 25 Å.

A protocol has been developed involving water dispersion, hot pressing, and oven annealing of the electrocatalysts to imitate the preparation of a typical fuel-cell electrode. See H. P. Dhar, supra. The usual additions of flocculants, binders, and ionomers are omitted because they interfere with the XPS measurements of carbon-associated sulfur, as discussed below.

Figure 4:
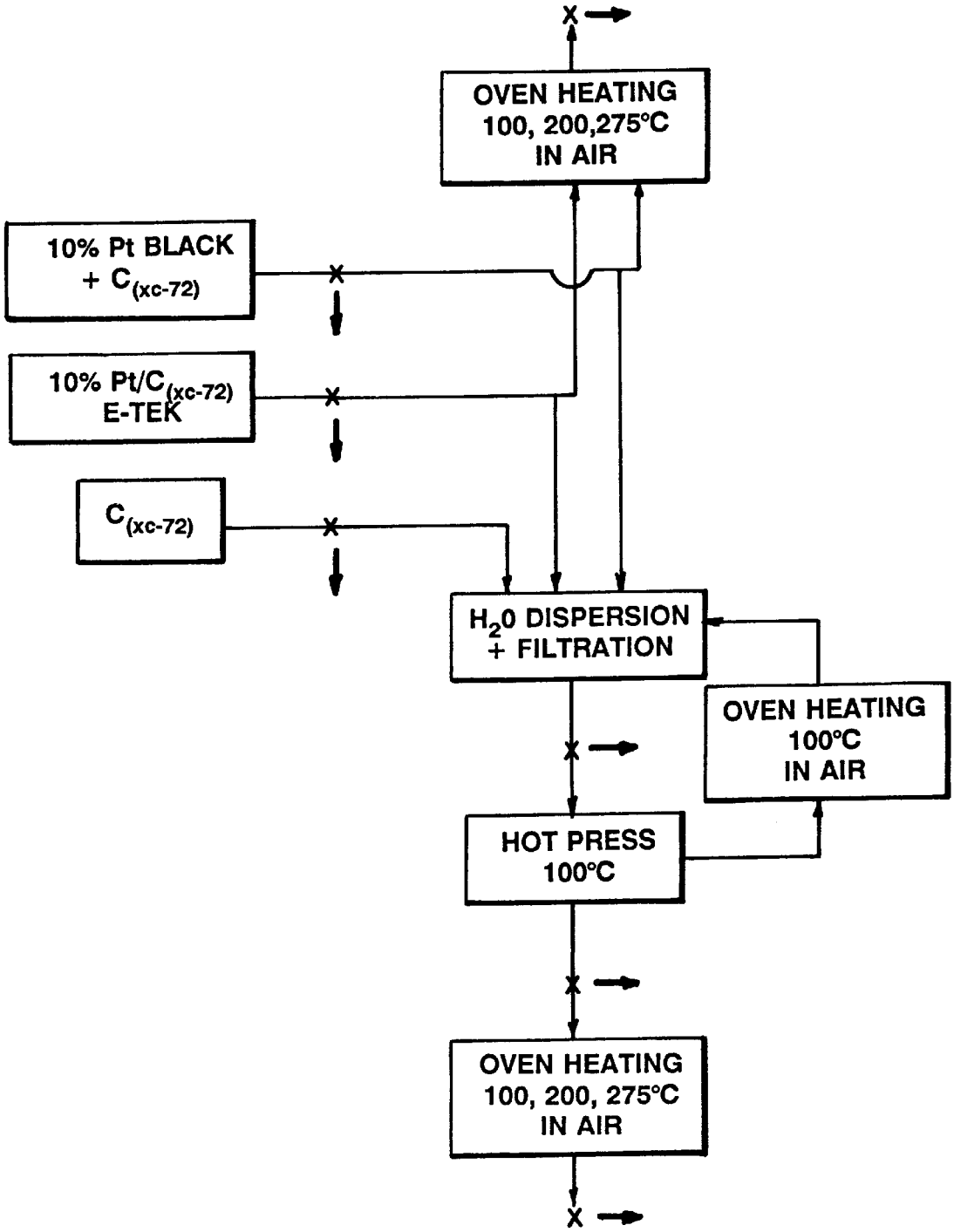
FIG. 4 is a flow chart showing the steps in a "mock" fuel-cell electrode preparation.
Figure 5A:
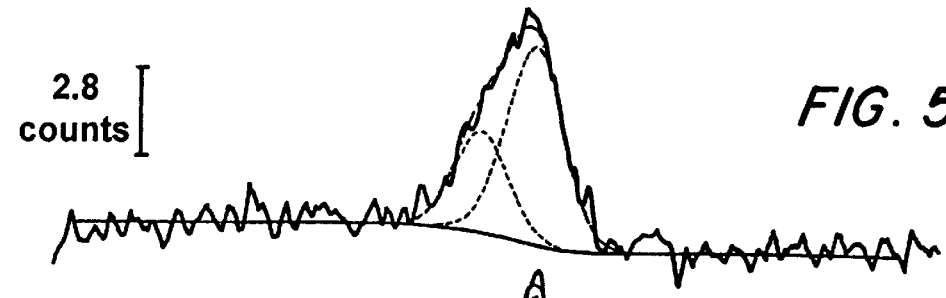
FIGS. 5*a*, 5*b*, 5*c*, 5*d*, and 5*e* are a series of XPS traces showing the S2p region of Pt/C.
Figure 5B:
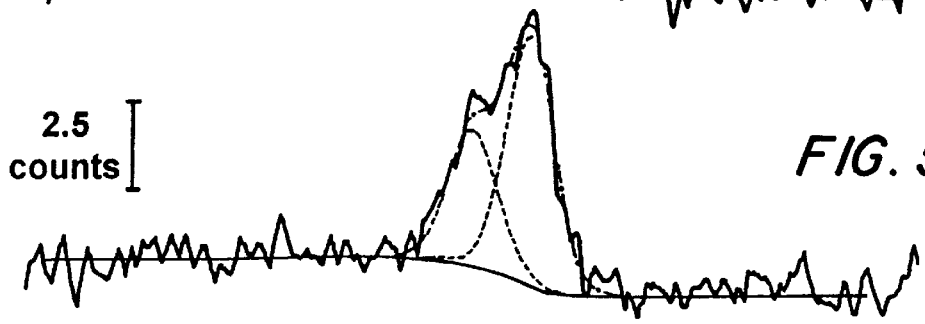
Figure 5C:
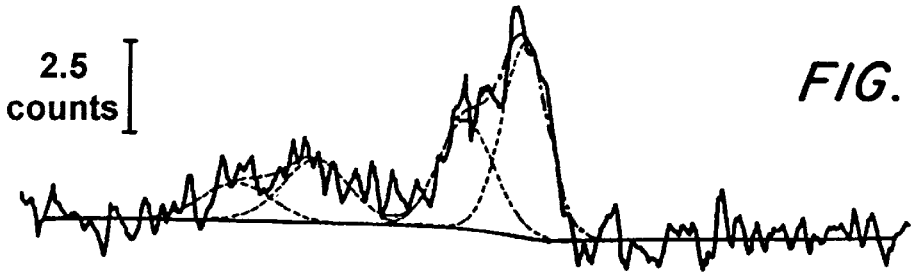
Figure 5D:
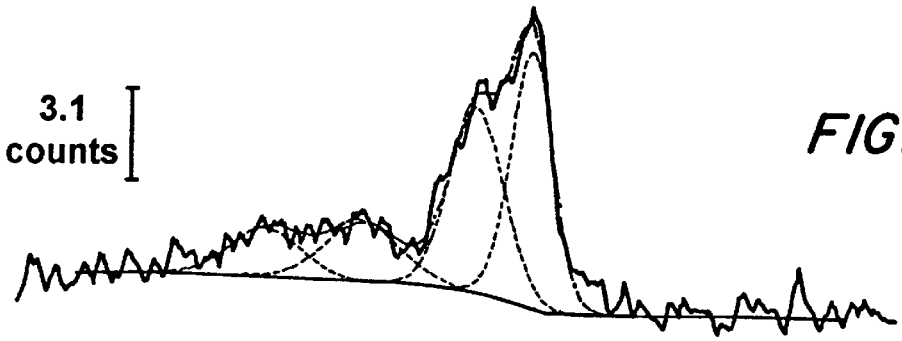
Figure 5E:
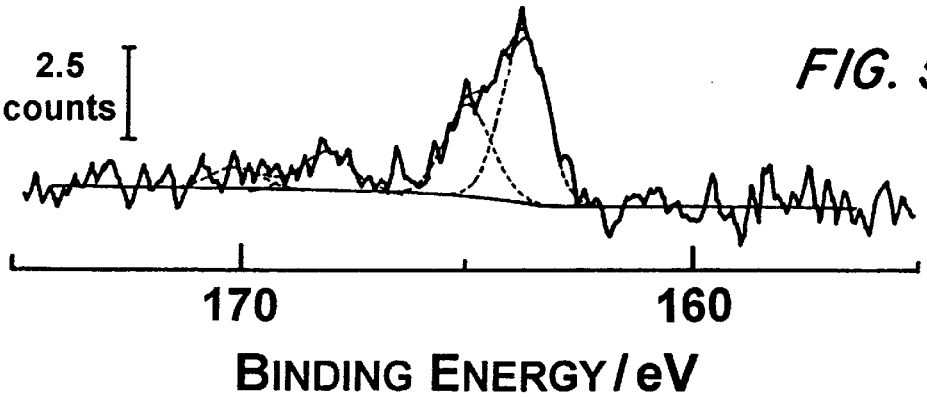
Figure 6A:
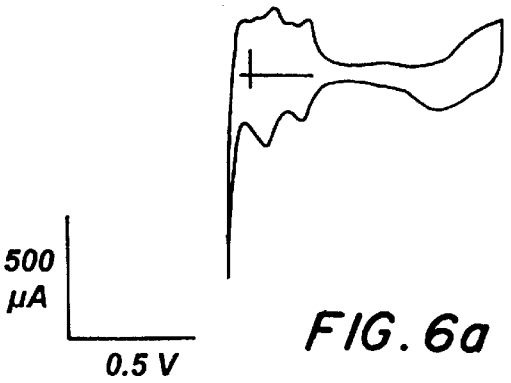
FIGS. 6*a*, 6*b*, 6*c*, 6*d*, 6*e*, 6*f*, 6*g*, and 6*h* are a series of cyclic voltammetry traces.
Figure 6B:
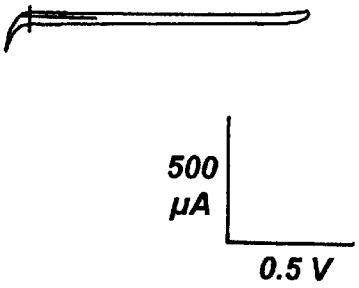
Figure 6C:
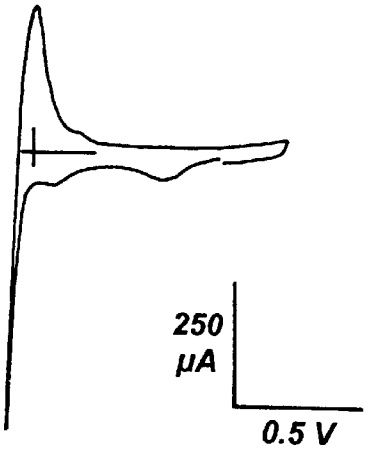
Figure 6D:
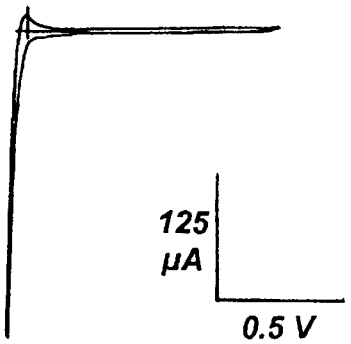
Figure 6E:
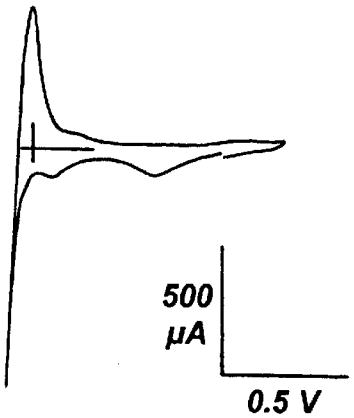
Figure 6F:
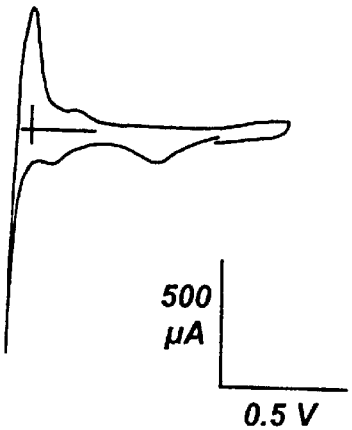
Figure 6H:
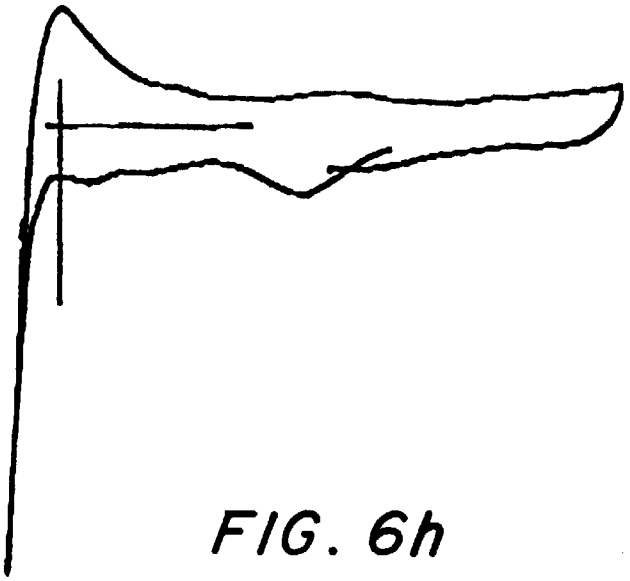
Figure 6G:
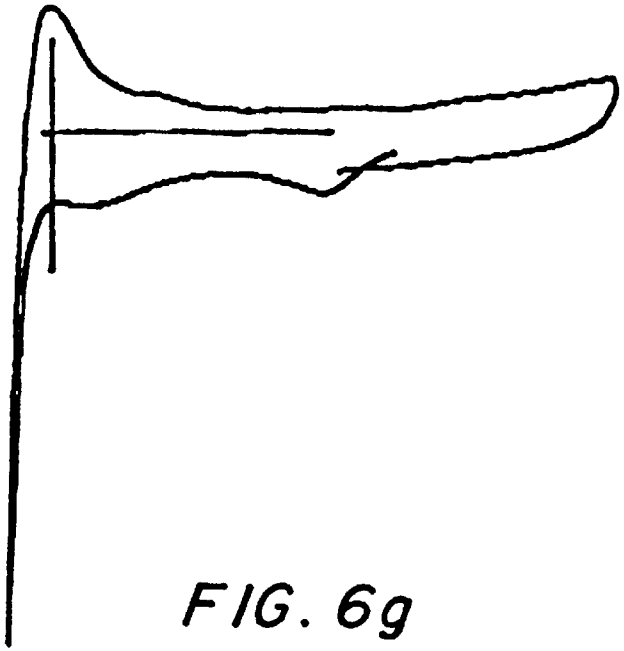

The treatment steps in our "mock" fuel-cell electrode preparation is summarized in a flow chart in FIG. 4. The symbol X→ indicates points at which samples were taken for the XPS, $Ba(OAc)_2$, and cyclic voltammetry analyses. Approximately 0.5 g of the electrocatalyst materials were dispersed in 100 mL of 18 MΩ-cm $H_2O$ (Bamstead NanoPure) and ultrasonicated for a total of 6 minutes (Sonics and Materials, Vibra Cell). The majority of the water was removed by filtration, and then the material was hot pressed on filter paper at 100° C. for 5 min at 1000 psi. The electrocatalysts were then scraped from the filter paper into an Al boat and oven heated in air stepwise at 100° C. (1 hr), 200° C. (1 hr), and 275° C. (15 min). To examine the influence of the heating procedures on the chemical state and content of the sulfur in the electrocatalysts, the water dispersion and heating steps were repeated. In these cases, the electrocatalysts were ultrasonicated in water, hot pressed, and heated in air at 100° C. (1 hr) and then once again dispersed in $H_2O$, hot pressed, and heated in air at 100° C. (1 hr), 200° C. (1 hr), and 275° C. (15 min). The electrocatalysts were not heated over 100° C. in the first half of this treatment to minimize the carbon oxidation and particle sintering that could occur by repetitive heating at the higher temperatures. For comparison to these water/heat treatments, the dry electrocatalysts were also heated in air at 100° C. (1 hr), 200° C. (1 hr), and 275° C. (15 min). It should be noted that heating to temperatures ≧≈100° C. are in all likelihood unnecessary to the desulfurization, but were done to fully imitate the standard fuel-cell electrode heat treatment steps.

At different stages of our mock fuel-cell electrode preparation (FIG. 4), the carbon-based materials were pressed into 99.99% indium foil (Johnson Matthey) and examined using XPS (Surface Science Instrument Model SSX-100-03 X-ray Photoelectron Spectrometer, Al K-α x-rays). The energies of the photoelectron lines were referenced to the Cls line of the vulcan carbon which is defined as graphite (Cls=284.2 eV). See J. F. Moulder, W. F. Stickle, P. E. Sobol, and K. D. Boben, Handbook of X-ray Photoelectron Spectroscopy, ed. J. Chastain, Perkin Elmer Corp., Eden Prairie, MN (1992). Due to both the low concentration of sulfur in the vulcan carbon (<1 atom %) and the weak photoelectron cross-section of sulfur ($\sigma_{Scofield\ S2p}$=1.677 relative to $\sigma_{Cls}$=1.000) (see J. H. Scofield, J. Electron. Spectrosc. Relat. Phenom., 8, 129 (1976)), at least 40 scans are required to obtain a signal having S/N>1.5 for the S2p photoelectron line (see FIG. 5, discussed in greate detail below). In several cases, we assign "trace" peaks indicating the possible presence of a low concentration of a sulfur species (<0.1 atom %). However, the actual presence of these trace peaks may be disputed as they are at the noise level of the background. The relative areas of elemental lines were determined using a $\chi^2$-minimization routine and corrected for cross-sectional and instrumental factors.

The presence of sulfate ions in the filtrate of the treated catalyst is examined qualitatively by the addition of aqueous barium acetate, $Ba(OAc)_2$, to form the water-insoluble white precipitate, $BaSO_4$. Filtrate is created from a water dispersion of the $C_{(XC\text{-}72)}$ and $Pt/C_{(XC\text{-}72)}$ materials after different stages of their treatment as described above. The processed materials are subjected to gravity filtration, and the resulting water is filtered again through a 0.45-μm membrane filter (Acrodisk) to remove extraneous carbon. Several milligrams of $Ba(OAc)_2$ are then dissolved in the filtrate and the formation of $BaSO_4$ precipitates is visually monitored. A clear solution results from a $Ba(OAc)_2$ test of filtered 18 MΩ-cm $H_2O$. A visibly cloudy solution indicates the presence of ≧8 ppm sulfate ion.

The variously treated $Pt/C_{(XC\text{-}72)}$ powders are prepared for electrochemical analysis by pressing them into the pinholes of a slightly porous glassy-carbon electrode. The $Pt/C_{(XC\text{-}72)}$-modified glassy-carbon electrodes are submerged in de-aerated 0.1 M $H_2SO_4$ vs. a Pt-wire auxiliary electrode and referenced to a Pd/H electrode. The cyclic voltammetric response is measured using a potentiostat (EG&G PAR model 173) and waveform sweep programmer (EG&G PAR model 175). A cycle is started at the open-circuit potential of the cell and is swept negative at 0.05 V/s to −0.01 V vs. Pd/H to map the initial state of the hydrogen adsorption sites on the platinum. The positive potential of the measurements is limited to 1.0 V to avoid extensive oxidation of the carbon.

FIG. 5 shows the XPS analysis of the S2p region of 10% Pt-black/$C_{(XC\text{-}72)}$ materials. Curve a shows VC1 (as-received vulcan carbon); curve b shows PTBC1 (as-ground 10% Pt-black/$C_{(XC\text{-}72)}$); c: PTBC3 (10% Pt-black/$C_{(XC\text{-}72)}$ after water dispersion and hot pressing); d: PTBC4 (10% Pt-black/$C_{(XC\text{-}72)}$ after water dispersion, hot pressing, and oven heating); e: PTBC5 (10% Pt-black/$C_{(XC\text{-}72)}$ after two treatments of water dispersion, hot pressing, and oven heating). The sample treatments and XPS results are summarized in Table I. Photoelectron lines at 163.8 and 168.2 eV are assigned to zero-valent organosulfur and sulfate species, respectively. The $S2p_{3/2}$ and $2p_{1/2}$ components are resolvable for these photoelectron lines and are shown by the dashed line. The calculated fit for the S2p envelope is indicated by -o-.

FIG. 6 shows a series of cyclic voltammetry traces for the experiments described below.

Figures 7A, 7B, 7C:
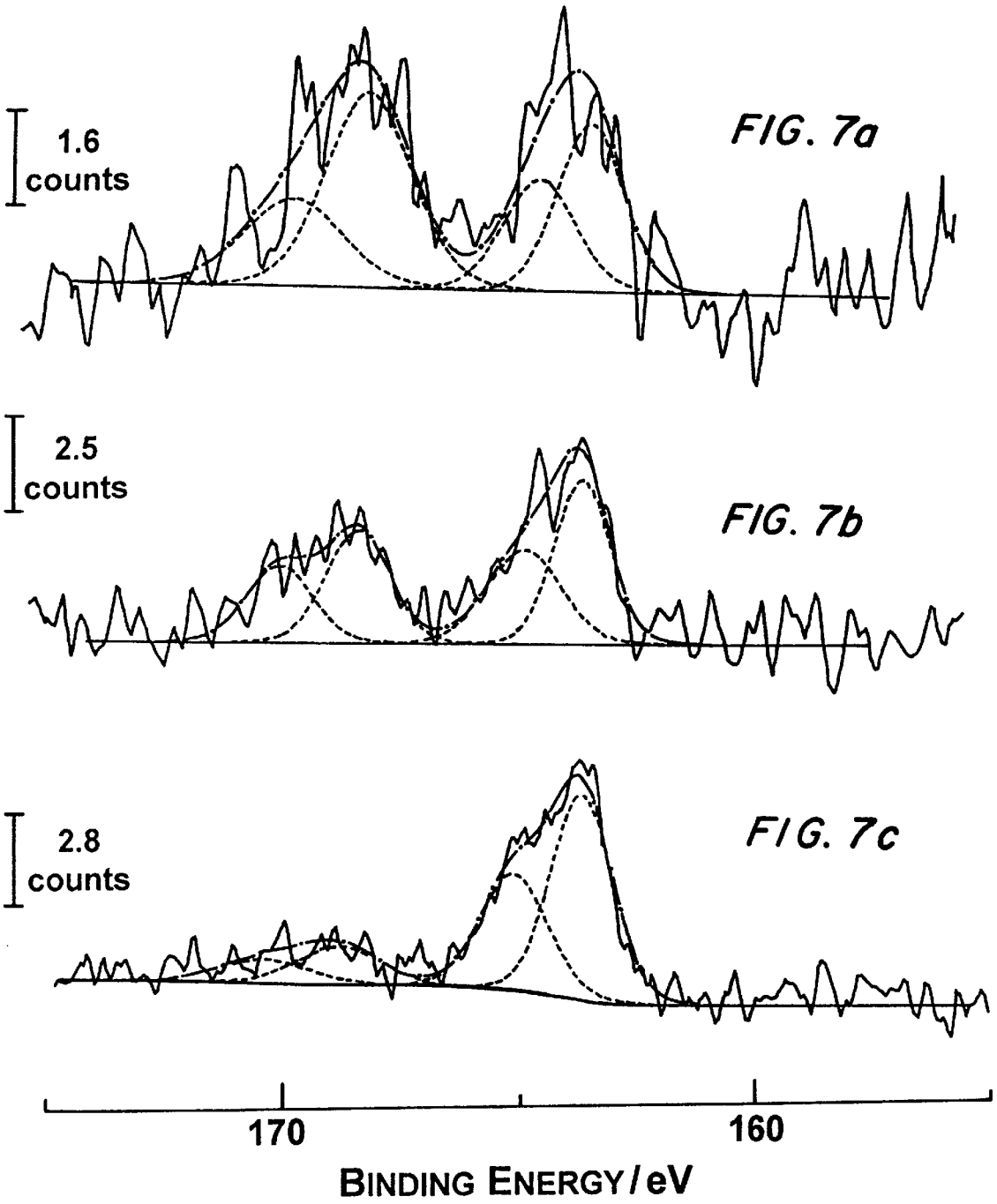
FIGS. 7*a*, 7*b*, and 7*c* are a series of XPS traces showing excess sulfate in Pt/C.

FIG. 7 shows a series of XPS traces showing the excess sulfate in Pt/C materials. Curve a shows as-received 10% $Pt/C_{(XC\text{-}72)}$ commerical catalyst [E-TEK] which has been synthesized from sulfate-based Pt precursors. Curve b shows 10% Pt-black/$C_{(XC\text{-}72)}$ which has been water suspended using $H_2SO_4$ as a flocculant; Curve c shows VC4 (vulcan carbon after two treatments of water dispersion, hot pressing, and oven heating).

EXAMPLE 1

Confirmation of the Presence of High Concentrations of Sulfur in Vulcan Carbon

Cabot Corp. reports sulfur concentrations of 5000 ppm (weight) or 0.19 atomic percent (at %) in their vulcan carbon XC-72, which is sufficient, on an atom basis, to poison the entire electrocatalyst surface in 10 wt % Pt-C. We have observed with X-ray photoelectron spectroscopy (XPS) concentrations of 0.36 at. % on the surface of the vulcan carbon XC-72. Using XPS, we have identified the sulfur in vulcan carbon as a zero-valent organo-sulfur species, such as thiophene.

EXAMPLE 2

Establishing that the Platinum in Fuel-Cell Electrodes Interacts with the Sulfur in the Vulcan Carbon Vulcan carbon was treated using the typical water and heat processing steps used to make a fuel-cell electrode, and XPS indicated that the chemical state and concentration of sulfur in the vulcan carbon was unchanged. See results in Table I: samples VC1 to VC4.

Platinum black was mixed with (or, in another experiment, Pt-clusters were supported on) vulcan carbon, and subjected to the same water and heat processing steps, and some of the sulfur in the vulcan carbon was oxidized to sulfate. This was verified using both XPS and a qualitative barium acetate, $Ba(OAc)_2$, precipitation test for sulfate in the wash from the Pt/carbon mixtures. See results in Table I: samples PTCE3 and PTBC4.

EXAMPLE 3

Establishing that platinum oxidizes the carbon-associated sulfur only under certain conditions We have shown that sulfate is not generated when water is not added to the Pt/carbon mixtures during processing. See Table I: PTCE2, PTBC2.

We have also shown that sulfate does not form if the platinum and carbon do not come in contact during processing: (1) a slurry of water and platinum heated to 100° C. for 1 hour tested negative for sulfate; (2) additional water and heat processing of the Pt/carbon mixtures generated no new sulfate, presumably because the Pt has reacted with all of the sulfur in its immediate environment (see results in Table I: PTCE4, PTBC5 and FIG. 1).

We have also shown that a platinum oxide ($PtO_x$, $0<x<2$) is needed for the sulfur oxidation: (1) XPS and cyclic voltammetry indicate that a Pt-oxide species is always present in the electrochemically active Pt/C materials (FIG. 6, traces c, e, and f); (2) when carbon slurries come in contact with a Pt-mesh electrode, the oxidation of the carbon-associated sulfur occurs only when a Pt-oxide is electrochemically stabilized on the electrode surface. These experiments are highlighted below.

EXAMPLE 4

Establishing that the sulfate does not poison the fuel-cell electrochemistry

Commercial Pt/C electrocatalysts (E-TEK) exhibit excellent electrocatalytic behavior even though they are synthesized from sulfate-based precursors and contain large amounts of excess sulfate, as we have shown. See Table I: PTCE1, and FIGS. 7 (trace a), and 6 (trace c). Furthermore, commercial Pt/C electrocatalyst having high concentrations of sulfate exhibits electrochemistry similar to that of Pt black (FIG. 6, trace a).

We have shown that when Pt/C mixtures are water and heat treated such that sulfate is generated, their electrochemistry is identical to that of the starting materials. See FIG. 6, traces c, e, and f.

EXAMPLE 5

Establishing that sulfur poisons the electrocatalysts.

It is known that sulfur poisons the noble metals. Previous research shows that $H_2S$ gas (a source of low-valent sulfur) poisons the electrocatalytic properties of Pt in PAFCs. C. The sulfur in vulcan carbon can poison the Pt electrochemistry under certain conditions. EXAMPLE: The platinum electrochemistry is compromised in Pt/C mixtures when they are heated in the absence of water and the oxidation of the sulfur to sulfate does not occur. See Table I: PTCE2, PTBC2 and FIG. 6, trace d. The Pt electrochemistry is not compromised in Pt/C mixtures when they are heated in the absence of $H_2O$ if the carbon has a low sulfur content (e.g., partially desulfurized vulcan carbon or acetylene black). See FIG. 6, showing the curves of a mixture of Pt black and desulfurized carbon before (trace g) and after (trace h) heating to 275° C. with no $H_2O$.

EXAMPLE 6

Establishing that the sulfur in vulcan carbon may shorten the lifetime of fuel-cells.

We have shown that only the carbon-associated sulfur which comes in contact with the Pt during the preparation of fuel cell electrodes, in the presence of water and heat, is oxidized to sulfate, and the remaining sulfur remains in the electrode materials as zero-valent sulfur. See Table I, PTCE3, PTCE4, PTBC4, and PTBC5.

Physicochemical conditions known to occur in operating platinum-catalyzed fuel cells will create new contact of Pt with carbon-associated sulfur in environments in which the combination of $PtO_x$, water, and temperature may not be optimal to oxidize the low-valent sulfur to innocuous sulfate ions. For example: the Pt electrocatalyst clusters move on the vulcan carbon support during the operation of a fuel cell and will therefore come in contact with new regions of unreacted sulfur over time. Reducing conditions exist at the cathode, which may inhibit the continued oxidation of the carbon-associated sulfur to sulfate by $PtO_x$ and allow the sulfur to poison the Pt surface. The anode can become "water-starved," a condition which could inhibit the oxidation of the carbon-associated sulfur to sulfate by $PtO_x$ and allow the sulfur to poison the Pt surface.

TABLE I

Results from XPS and $Ba(OAc)_2$ analyses of various vulcan carbon and Pt-vulcan carbon powders after water and heat treatments.

| sample name | sample description | B.E. (eV) S 2p | B.E. (eV) $S^{x+}$ 2p | at % S 2p | at % S | presence of $BaSO_4$ |
|---|---|---|---|---|---|---|
| PTB | Pt-black | n/a | n/a | — | — | n/a |
| PTBC1 | 10% Pt-black/C | 163.60.3 | 168.80.3* | 0.350.06 | 0.350.06 | no |
| PTBC2 | Δ | 164.0 | — | 0.32 | 0.32 | no |
| PTBC3 | ≈ ↓ | 163.60.1 | 168.30.2 | 0.440.06 | 0.360.04 | no |
| PTBC4 | ≈ ↓ Δ | 163.60.1 | 168.20.8 | 0.430.06 | 0.330.04 | yes |
| PTBC5 | ≈ ↓ ○ ≈ ↓ Δ | 163.60.3 | 168.10.3 | 0.440.08 | 0.390.07 | no |
| PTCE1 | 10% Pt/C (E-TEK) | 164.0 | 168.5 | 1.04 | 0.42 | yes |
| PTCE2 | Δ | 163.9 | 168.2 | 0.76 | 0.46 | no |
| PTCE3 | ≈ ↓ Δ | 163.80.2 | 168.00.2 | 0.810.12 | 0.360.02 | yes |
| PTCE4 | ≈ ↓ ○ ≈ ↓ Δ | 163.70.1 | 168.50.4 | 0.980.23 | 0.370.08 | no |
| VC1 | C (XC-72) | 163.9 | — | 0.36 | 0.36 | no |
| VC2 | ≈ ↓ | 163.8 | 169.1* | 0.42 | 0.34 | no |
| VC3 | ≈ ↓ Δ | 163.9 | — | 0.37 | 0.37 | no |
| VC4 | ≈ ↓ ○ ≈ ↓ Δ | 163.7 | 169.1* | 0.44 | 0.36 | no |

The atomic percentages are calculated relative to the carbon peak. The sample treatments are summarized using the following notation:
≈ = dispersion in water
↓ = hot pressing
Δ = oven treatment in air at 100 C. (1 hr), 200 C. (1 hr), and 275 C. (15 min)
○ = oven treatment in air at 100 C. (1 hr).
The order of the symbols represents the sequence in which the procedures are executed.
*A trace amount (<0.1 atom %) of a high valence S-oxygen species (sulfate) may be present.
n/a = not applicable

General Experimental Procedures and Standards (Desulfonation Examples)

Figure 3:
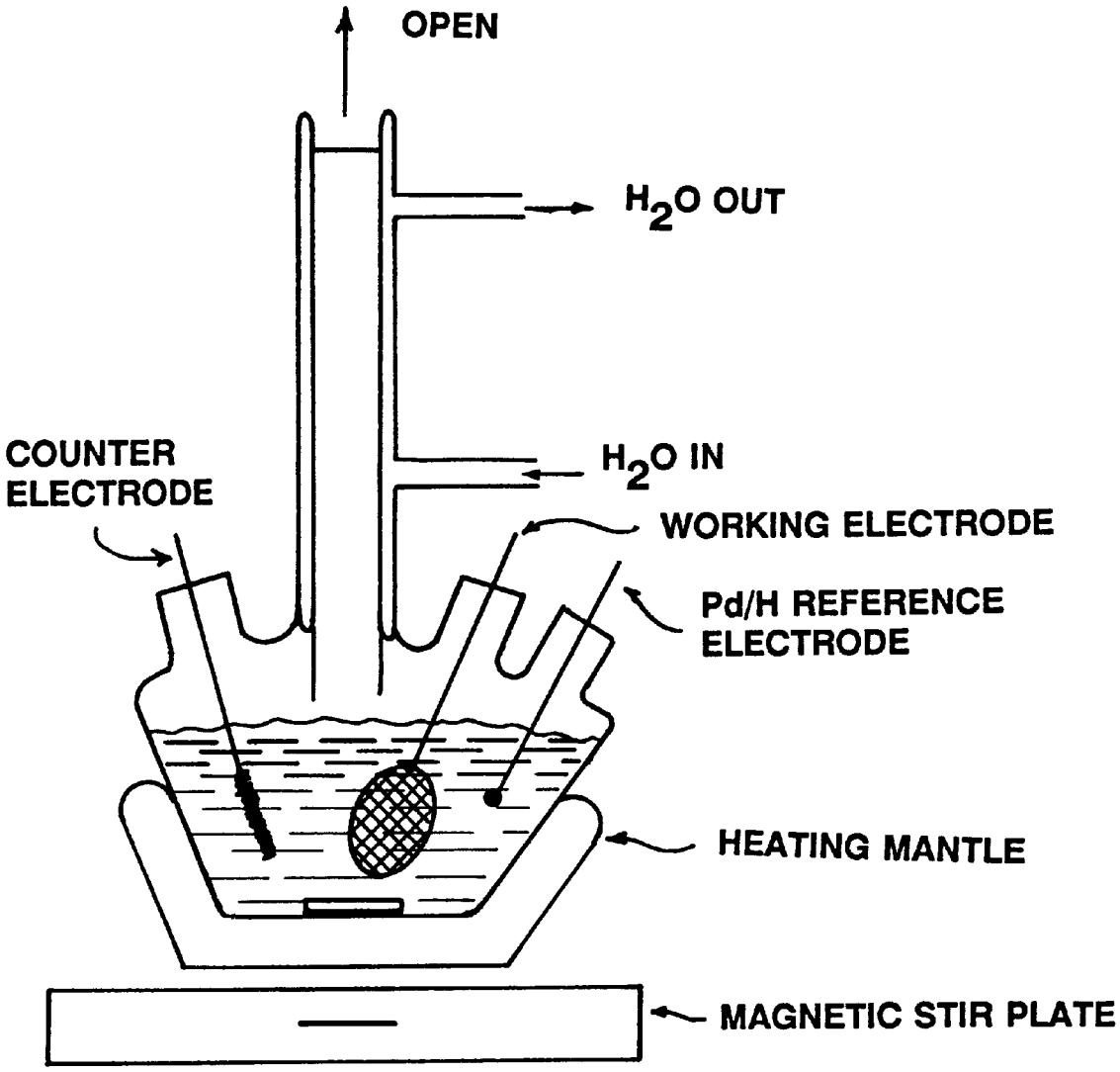
FIG. 3 is a representation of an apparatus used to desulfonate carbon samples.

Referring to FIG. 3, the apparatus used to desulfonate carbon samples included a four-aperture flask on a heater. The flask contained a 0.05 M solution of $HNO_3$ (about 50 ml), and 0.5 g vulcan carbon. The cathode and anode were high surface area Pt electrodes, and were inserted into the reaction flask through two of the ports. A hydrogen reference electrode (Pd/H) was inserted in the third port, and the fourth port held a water-cooled condenser, to reflux any water vapor back into the flask. The solution was then heated to about 100° C. and stirred. Various potentials were applied for various times to the Pt electrode, thus controlling the surface oxidation state of the Pt electrode. After 1–3 hours, the aqueous carbon solution was tested for sulfate using the qualitative $Ba(OAc)_2$ test. Only when the Pt working elctrode was poised in the $PtO_x$ region of the cyclic voltammagram did the aqueous solution test positive for sulfate, indicating the presence of ≧8 ppm sulfate. XPS analyses of the aqueous carbon solution in contact with the $PtO_x$ for 3 hours shows significant reduction of the organo-sulfur concentration.

EXAMPLE 7

Desulfurization of Carbon Samples

The procedures outlined above were followed at potentials of 0.0 0.5, 1.0, and 1.3 V vs. a Pd/H electrode. Results are shown in Table II.

TABLE II

Desulfurizations at various potentials

| potential→ time↓ | 0.0 V vs. Pd/H (Pt°) | 0.5 V vs. (Pd/H) (Pt°) | 1.0 V vs. Pd/H ($PtO_x$) | 1.3 V vs. Pd/H ($PtO_2$, $O_2$ evolution) |
|---|---|---|---|---|
| 1 hr | no $SO_4^{2-}$ | no $SO_4^{2-}$ | $SO_4^{2-}$ | no $SO_4^{2-}$ |
| 3 hr | — | — | additional $SO_4^{2-}$, almost no S° | — |

Obviously, many modifications and variations of the present invention are possible in light of the above teachings. It is therefore to be understood that, within the scope of the appended claims, the invention may be practiced otherwise than as specifically described.

What is claimed is:

1. A process for removing low-valent sulfur from carbon containing low-valent sulfur, comprising the steps of:

placing carbon containing low-valent sulfur in an aqueous electrochemical cell, said electrochemical cell having a weak electrolyte solution of not greater than 0.05 molar wherein the said solution is selected from the group consisting of aqueous acid solutions, aqueous base solutions, and aqueous salt solutions, said electrochemical cell having a cathode a platinum anode;

electrochemically forming platinum oxide by applying a potential of 1.0 volt versus a hydrogen reference electrode to a platinum electrode in said cell and bringing said carbon containing low-valent sulfur into contact with said platinum oxide, for a time sufficient to remove a desired amount of low-valent sulfur from said carbon.

2. The method of claim 1, wherein said carbon is selected from the group consisting of vulcan carbon, pyrolytic carbon, glassy carbon, carbon blacks, coal, petroleum, and petroleum distillates.

3. The method of claim 1, wherein said carbon is a slurry, powder, or cloth.

4. The method of claim 1, wherein said contacting said carbon with said platinum oxide is by dispersing said carbon and said platinum oxide in water.

5. The method of claim 1, further comprising the step of:

removing said carbon from said platinum oxide, after said step of contacting said carbon containing low-valent sulfur with said platinum oxide.

* * * * *